United States Patent [19]

Sherwood

[11] 4,105,438

[45] Aug. 8, 1978

[54] CONTINUOUS METAL MELTING, WITHDRAWAL AND DISCHARGE FROM ROTARY FURNACES

[76] Inventor: William Lyon Sherwood, 6968 Ash St., Vancouver, British Columbia, Canada

[21] Appl. No.: 788,995

[22] Filed: Apr. 19, 1977

[51] Int. Cl.[2] ..... C21C 7/10

[52] U.S. Cl. ..... 75/49; 75/46; 75/65 R; 75/93 R; 75/129; 75/135; 266/239

[58] Field of Search ..... 75/46, 49, 40, 38, 65 R, 75/68 R, 93 R, 129, 135; 266/236, 237, 238, 239

[56] References Cited

U.S. PATENT DOCUMENTS

| | | | |
|---|---|---|---|
| 3,385,585 | 5/1968 | Kawawa | 266/236 |
| 3,467,167 | 9/1969 | Mahin | 75/49 |
| 3,558,121 | 1/1971 | Lenne | 75/49 |

*Primary Examiner*—M. J. Andrews

[57] ABSTRACT

A refractory siphon tube is inserted through the axial discharge opening of a rotary melting furnace and down through the slag into the metal within the furnace. Molten metal is withdrawn continuously by suction through the tube into an enclosed chamber maintained under a controlled negative suction pressure through a suction manifold connecting with a receiver, vacuum pump and pressure controller. The enclosed chamber discharges by gravity through a bottom opening, either emptying into a launder with an overflow weir, or discharging directly out through a bottom nozzle equipped with a slide-gate shut-off. The metal is discharged continuously at a controlled rate irrespective of any variations in the feed rate and metal depth in the furnace. The metal depth can be varied by periodically varying the suction pressure and thus can provide for intermittent slag discharge by overflowing the annular discharge opening. The depth of the enclosed chamber may be varied as desired, a high vacuum pressure being logically employed with the deeper units which thus also act as vacuum degassers for removing dissolved gases in the molten metal.

10 Claims, 2 Drawing Figures

CONTINUOUS METAL MELTING, WITHDRAWAL AND DISCHARGE FROM ROTARY FURNACES

Figures 1, 2:
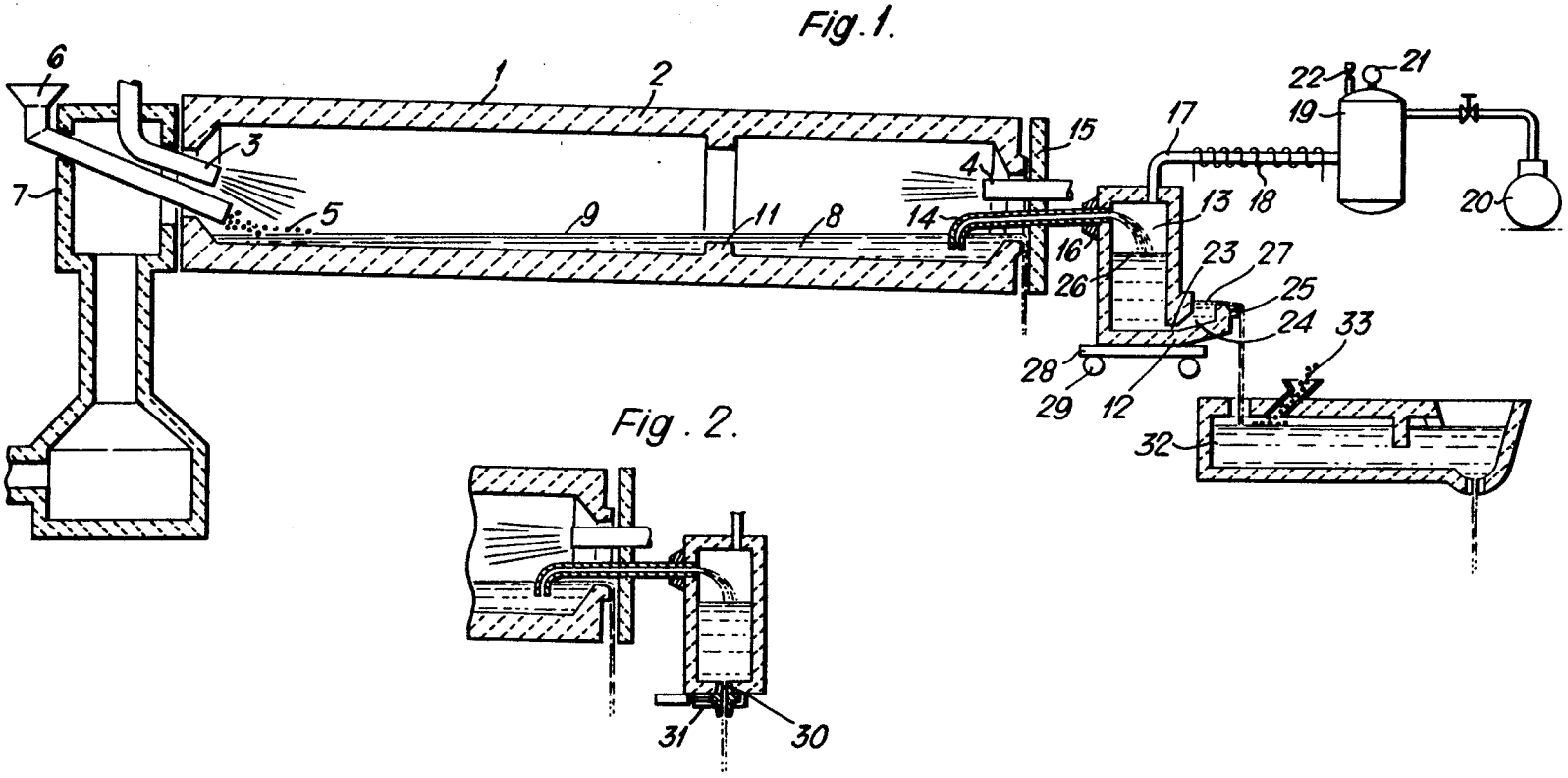

The invention relates to the melting, refining and casting of molten metals and alloys and, more particularly, to an improved method and apparatus for the continuous withdrawal and discharge of molten metal from a rotary furnace through its axial end opening.

Rotary furnaces used for melting metals on a batch basis are normally tapped through a tap hole located in the wall of the furnace. The furnace rotation is stopped, the tap hole opened by a ram or lance, and the metal tapped out quickly into a ladle. For continuous operation, discharge can be accomplished by overflowing over the lip of an axial discharge opening, but the general discharge rate is subject to changes of the charge replenishment rate and is also subject to surges from other sources. An elaborate furnace tilt-incline mechanism can be employed to secure a degree of control, but is cumbersome in use. Further, slag and metal normally discharge simultaneously during lip discharging and special means are necessary for slag-metal separation, either at the discharge lip or following discharge.

Siphoning of metals into an external withdrawal chamber by application of controlled suction is known practice, for example, the well known closed ladle siphon for withdrawal of molten aluminum from aluminum reduction pots. These techniques provide for filling up individual ladles, molds, or other batch vessels, and are not well suited to continuous operation.

It is therefore a principal object of the present invention to accomplish the continuous withdrawal of molten metals at a controlled rate from within rotary furnaces through axial discharge openings essentially independently of the replenishment rate from charging or other causes of small metal level changes within the furnace.

It is another object of the present invention to withdraw molten metal from a furnace separately from the slag, thus providing the opportunity for convenient discharge of slag by separate means.

It is another object of the present invention to limit reoxidation of molten metal by exposure to the external atmosphere during withdrawal, transfer and discharge from a process vessel.

Still another object of this invention is to provide a method of metal withdrawal from a furnace on a continuous basis particularly suitable for a continuous casting directly following the withdrawal operation.

A further object of the present invention is to provide a method which removes dissolved gases from the molten metal.

It is a still further object of the invention to maintain a constant and controlled flow rate of discharged metal irrespective of surges or periodic interruptions in the furnace charging rate to enable close control of final metal composition by continuous alloy addition at a controlled rate varied according to flow rate of withdrawal of the molten metal.

The invention comprises, in a method for continuous melting and refining in a rotary furnace in which a charge of liquid metal is confined within the furnace by retaining it behind an annular dam restriction of the discharge opening, the combination of the following steps:

(a) maintaining an external metal withdrawal vessel adjacent to the discharge end of the rotary furnace incorporating an enclosed chamber as part of the vessel;

(b) maintaining a negative suction pressure within the enclosed chamber;

(c) maintaining a discharge siphon tube inserted down into the metal within the rotary furnace and connecting into the enclosed chamber;

(d) allowing the molten metal to flow from the metal bath within the furnace through the siphon tube into the enclosed chamber at a rate controlled by the magnitude of the negative suction pressure; and (e) allowing the metal to flow out and discharge concurrently from a submerged opening in the enclosed chamber under the influence of gravity, and at an average rate corresponding to the rate of withdrawal from the furnace through the siphon tube.

The invention provides for continual withdrawal at approximately the overall average charge rate by maintaining a controlled and substantially constant negative suction pressure within the enclosed chamber, enabling the continuous subsequent addition of alloys and deoxidizers at a similarly constant and controlled rate to maintain a corresponding close control of the final composition of the cast product. The invention thus overcomes control problems stemming from intermittent and/or periodic furnace charging, as from a charging box inserted into the furnace and dumped at spaced time intervals, by eliminating the resulting surges and providing a measured flow for control of the quantity of alloy additions.

Following from this, the invention is also particularly suited to the situation where charge material is continually introduced into the charge end of the rotary furnace and the negative suction pressure is regulated to effect metal withdrawal at an average rate corresponding to the rate of supplying charge material, thus maintaining a substantially constant average level of metal within the furnace. The method provides the convenient facility for periodically varying the suction pressure and hence the average metal level above and below this average level, thus effecting the periodic discharge of slag over the annular dam restriction of the discharge opening. This practice can greatly facilitate slag removal, particularly if the slag is viscous or of inconsistent consistency.

The invention may employ either of two different methods of discharging from the enclosed withdrawal chamber. In the first method, the withdrawal vessel incorporates an open launder communicating with the enclosed chamber via the submerged discharge opening; and the metal flows into the launder and is allowed to discharge by overflowing a weir-type side discharge lip at a rate corresponding to the flow rate into the launder through the submerged opening. In the second method, the enclosed chamber contains a bottom nozzle and the metal is discharged by gravity directly out through this nozzle opening. This nozzle is beneficial for emptying the vessel when pouring is completed and is also normally equipped with a slide-gate device for opening and closing, which facilitates the evacuation of the vessel to initiate the flow at start-up.

Various other objects, features and advantages of the method and apparatus of this invention will become apparent from the following detailed description and claims, and by referring to the accompanying drawings.

FIG. 1 is a elevation view, diagramatic partly in section, of the process and apparatus in operation, and FIG. 2 is another embodiment of the withdrawal vessel illustrating an alternative method of discharge.

Referring to the drawings, the rotary furnace comprises a body consisting of a cylindrical steel shell 1, lined with refractory material 2, and is rotated on trunnions mounted on an appropriate foundation (not shown). The furnace is fired with gas or oil by a charge end burner 3 supplying heat for melting, and a discharge end burner 4 regulating the temperature prior to discharge. The furnace charge 5 is fed into the annular charge opening via charge chute 6, entering directly in a partially molten metal bath in the embodiment illustrated. Waste gases are collected within charge hood 7 and passed through appropriate ducting, with heat exchangers and dust collectors as required. The metal bath 8 extends along the length of the furnace and is normally covered by a layer of slag 9 which can be allowed to overflow through the annular discharge opening. The annular dam 11 restricts the transfer of metal between the melting zone near the charge end and the refining zone near the discharge end and therefore assists in stabilizing the metal composition within the refining zone in preparation for discharge.

The metal withdrawal vessel 12 consists of an outer steel shell lined with refractory material and including an enclosed chamber 13. A siphon tube 14 is arranged to extend laterally into the furnace and is bent downward at the inlet end to penetrate through the slag with the inlet end kept immersed in the metal during operation. The siphon tube extends laterally from the furnace at a slight incline to facilitate drainage on completion of an operating campaign and is connected at its discharge end into the upper part of the enclosed chamber. It is supported by an appropriate flange support 16 allowing convenient connection and removal, the joint effecting a sealed connection. The siphon tube is generally made of high quality refractory-ceramic material such as fused alumina silicate, and the molten metal flows by suction through a longitudinal central opening to discharge into the enclosed chamber 13. The slag is then discharged from the furnace separately, normally by overflowing over the lip of annuar dam 10.

The negative suction pressure, as required for metal withdrawal, is maintained by a vacuum pump and evacuation system. The manifold 17 is traced with a cooling coil 18 and connects the top of the enclosed chamber 13 to a receiver tank 19 (condenser) which settles out dust and dirt as well as the greater part of the moisture in the gases removed from the metal. This tank is evacuated by the vacuum pump 20 via a valved manifold. The pressure in the system is regulated at a controlled setting by the vacuum controller 21 connected into the receiver tank, which is also equipped with an air bleed valve 22.

In the metal withdrawal vessel 12, FIG. 1, the enclosed chamber 13 connects through its bottom outlet opening 23 with an open launder 24 which permits discharging of the molten metal by overflowing the weir-type discharge lip 25. In operation, the metal pressure head represented by the difference in metal level 26 within the chamber and level 27 in the launder, corresponds to the controlled negative suction pressure. As this difference is increased, the rate of metal withdrawal through the siphon tube 14 also increases, according to the principles of Bernoulli's theorem. By maintaining a constant suction pressure, a continuous flow of metal is maintained through the siphon tube into the enclosed chamber, then the launder, finally discharging over the lip.

An initial vacuum is required to start the flow, and therefore the opening 22 must be temporarily sealed off with a refractory plug until a pressure head of metal equal to the vacuum is secured within chamber 13, at which time the opening is cleared and continuous flow begins. Another method of starting flow is to fill the vessel with starting metal by pouring in via the open launder top, prior to creating the withdrawal vacuum.

Regarding emptying at the end of a campaign, the withdrawal vessel will remain full of metal when ceasing withdrawal, and must be emptied by tilting. The vessel may also incorporate a bottom nozzle and slide gate for emptying as with the apparatus of FIG. 2, but normally discharging via the launder, with the bottom nozzle being used only for emptying the vessel.

There are various forms of equipment and techniques which may be employed for supporting the withdrawal vessel, and for inserting, positioning and withdrawing the siphon tube, which are not illustrated in detail. The unit shown is mounted on a track-mounted carriage 28 riding on wheels 29. The withdrawal vessel itself rests on pivot trunnions on either side of the carriage as part of a cradle, with the pivot points at the approximate center of gravity of the withdrawal vessel. The cradle (not shown) also includes a locking-support device to fasten the vessel in the fixed operating position shown. This arrangement is simple and efficient when used in conjunction with an overhead crane and multiple withdrawal vessel units.

FIG. 2 shows an alternative withdrawal vessel unit, and method of discharge whereby the metal is discharged by way of a nozzle 30 in the bottom of the enclosed chamber rather than into an overflow launder. By employing a slide-gate apparatus 31 for opening and closing the nozzle, as now commonly used in ladles and continuous casting tundishes, this arrangement has the advantage of convenient closure and sealing to initiate flow on starting vacuum, and also provides for complete emptying on shut-down while the withdrawal unit remains in the operating position. The relationship between flow rate, nozzle size, siphon tube size and vessel height is governed according to the principles of Bernoulli's theorem. When initiating the pour, the metal pressure head within the vessel must be allowed to increase to correspond approximately to the vacuum applied before opening the nozzle, after which continuous and balanced flow can be maintained. Selection of the diameter of the siphon tube and nozzle openings are governed by the desired flow rate and suction pressure employed.

Final alloying and deoxidation of metal may be accomplished in the launder 24 by lance injection or continuous feeding of sized material, or the metal may be discharged into a holding furnace or heated tundish 32 where this is accomplished by feeding directly into this vessel via an appropriate chute 33. The rate of feeding alloys is governed by the rate of metal withdrawal, in fact, the control may be interlocked to vary with the amount of negative suction pressure within the enclosed chamber.

It will be appreciated that a preferred embodiment of the method and apparatus for metal withdrawal and discharge of a rotary furnace has been described and illustrated and that variations and modifications may be made by persons skilled in the art, without departing from the spirit and scope of the invention defined in the appended claims.

I claim:

1. In a method for continuous melting and refining in a rotary furnace in which a charge of liquid metal is confined within the furnace by retaining it behind an annular dam restriction of the discharge opening at the furnace discharge end; the combination of the following steps:

(a) maintaining an external metal withdrawal vessel proximate to discharge end of said rotary furnace incorporating an enclosed chamber as part of said vessel;

(b) maintaining a discharge siphon tube inserted down into the metal within the rotary furnace and extending out laterally through the discharge opening to connect into said enclosed chamber;

(c) externally applying a negative suction pressure to said enclosed chamber, also thereby providing for evacuation of any dissolved gases emanating from the molten metal within the chamber as a result of said negative pressure;

(d) allowing the molten metal to flow from the metal bath within the furnace through the opening of said siphon tube into the metal inlet of said enclosed chamber at a rate controlled by the magnitude of said negative suction pressure;

(e) controlling the rate of metal flow through said inlet by controlling the magnitude of said negative suction pressure; and (f) allowing the metal to flow out and discharge concurrently from a submerged opening in the enclosed chamber under the influence of gravity, and this flow taking place at an average rate corresponding to the rate of withdrawal from the furnace through said siphon tube.

2. A method as in claim 1 in which the rotary furnace is elongated and contains a melting zone proximate the charge end and a refining zone proximate the discharge end, including the steps of:

(a) feeding charge material into the furnace charge end batch-wise on a continuing but intermittent basis; and (b) regulating said negative suction pressure to maintain continuous metal withdrawal and discharge from said refining zone at an overall average rate corresponding approximately to the average charge rate realized by the said feeding on an intermittent basis.

3. A method as in claim 2 also including the step of continuously feeding alloys into the metal after discharge at a rate proportional to the metal withdrawal rate as controlled by said negative suction pressure.

4. A method as in claim 1 in which the rotary furnace is elongated and contains a melting zone proximate the charge end and a refining zone proximate the discharge end, including the steps of:

(a) continually supplying charge material into the charge end of said rotary furnace; and (b) regulating said negative suction pressure whereby metal withdrawal occurs at an average rate corresponding to the rate of supplying charge material, thus maintaining a substantially constant average level of metal within the furnace.

5. A method as in claim 4 including the step of periodically varying the negative suction pressure above and below said average rate to provide for periodic increases of the metal level within the furnace to effect intermittent discharge of slag over said annular dam restriction, interspersed with periods of decreased metal level and substantially complete slag retention within the furnace.

6. A method as in claim 1 including the step of:

(a) maintaining an open launder communicating with said enclosed chamber via said submerged opening; and (b) allowing the metal to discharge from the launder by overflowing a discharge lip in the launder wall at a rate corresponding to the flow rate into the launder through said submerged opening.

7. A method as in claim 1 in which said submerged opening comprises a nozzle in the bottom of said metal withdrawal vessel through which the metal discharges directly from said enclosed chamber.

8. A metal withdrawal vessel adapted for continuous withdrawal, transfer and discharge of molten metal from within a pool of metal retained behind an annular dam restriction forming the discharge end opening of a rotary furnace, comprising:

(a) an enclosed chamber external to the discharge end of the furnace adapted for holding molten metal and continuously maintained under a controlled suction pressure during operation;

(b) a metal withdrawal siphon tube disposed laterally and inserted into the furnace through said discharge end opening with the inlet end immersed below the surface of said molten metal and the outlet end inserted into said enclosed chamber, said siphon tube thus being adapted for withdrawing and transferring under the influence of said controlled suction pressure, molten metal from the process furnace into said chamber;

(c) a controlled pressure suction line connecting into said enclosed chamber for maintaining said controlled suction pressure and also withdrawing any gases evolved from said molten metal or introduced by any air leakage during withdrawal;

(d) a submerged bottom opening in said enclosed chamber adapted to automatically allow discharge of molten metal by gravity from said enclosed chamber at an average rate corresponding to the rate of metal transfer into said withdrawal chamber via said siphon tube.

9. An apparatus according to claim 8 in which said metal withdrawal vessel includes an open launder connecting with said enclosed chamber via said submerged bottom opening allowing the metal to flow into the launder by gravity; and a discharge lip in the launder wall over which the metal continually overflows and is thereby discharged.

10. An apparatus according to claim 8 in which said submerged bottom opening comprises a nozzle equipped with a gate valve adapted for closing the nozzle to substantially prevent passage of molten metal at the time of commencing suction and metal withdrawal, and for opening when the molten metal within said enclosed chamber has reached a minimum operating metal depth required to secure continual discharge, and thereafter to allow essentially continuous discharge from said nozzle opening.

* * * * *